US005167295A

United States Patent [19]

Moog

[11] Patent Number: 5,167,295

[45] Date of Patent: Dec. 1, 1992

[54] VEHICLE, IN PARTICULAR A CHASSIS OF A BRIDGE-UNDERSIDE INSPECTION APPARATUS

[76] Inventor: Alfons Moog, Untersiggingen 110, 7774 Deggenhausertal 3, Fed. Rep. of Germany

[21] Appl. No.: 721,637

[22] PCT Filed: Jan. 23, 1990

[86] PCT No.: PCT/DE90/00038

§ 371 Date: Jul. 23, 1991

§ 102(e) Date: Jul. 23, 1991

[87] PCT Pub. No.: WO90/08228

PCT Pub. Date: Jul. 26, 1990

[30] Foreign Application Priority Data

Jan. 23, 1989 [DE] Fed. Rep. of Germany ... 8900673[U]

[51] Int. Cl.[5] ..... B62D 61/12; B66F 11/04; E01D 19/10

[52] U.S. Cl. ..... 180/209; 180/321; 180/342; 280/704

[58] Field of Search ..... 280/704, 688; 180/209, 180/321, 342

[56] References Cited

U.S. PATENT DOCUMENTS

| | | | |
|---|---|---|---|
| 676,409 | 6/1901 | Berger | 180/342 |
| 1,005,291 | 10/1911 | Owen | 180/342 |
| 3,502,165 | 3/1970 | Matsukata | 180/209 |
| 4,318,451 | 3/1982 | Liggett | 180/321 |
| 4,846,581 | 7/1989 | Osterlund et al. | 180/321 |
| 4,886,290 | 12/1989 | Pourchon et al. | 280/704 |

FOREIGN PATENT DOCUMENTS

| | | |
|---|---|---|
| 0120332 | 10/1984 | European Pat. Off. . |
| 0134311 | 11/1985 | European Pat. Off. . |
| 3305384 | 3/1984 | Fed. Rep. of Germany . |
| 2496015 | 6/1982 | France . |

*Primary Examiner*—Kenneth R. Rice
*Attorney, Agent, or Firm*—Spencer, Frank & Schneider

[57] ABSTRACT

A vehicle is proposed, in particular a chassis of a bridge-underside inspection apparatus, having a frame (1) and road-vehicle wheels. In order to be able to quickly and simply convert such a vehicle into an operational chassis having increased stability, a pneumatically sprung axle unit (3) and, in front of and/or behind this pneumatically sprung axle unit, at least one unsprung auxiliary wheel (7, 8) are arranged on the frame (1). The axle unit (3) has a pneumatically actuated device (4, 5) which is connected to the spring-suspension arrangement and by means of which the frame (1) can be lowered from a top position in which the spring suspension is effective into a bottom position. The auxiliary wheel (7, 8) is lifted from the roadway in the top position of the frame (1) during the road-transport operation and stands on the roadway in the bottom position of the frame (1) during working operation. Supporting rollers (6), which also serve as a slow drive, can be arranged above the wheels of the axle unit (3), (FIG. 1).

10 Claims, 3 Drawing Sheets

VEHICLE, IN PARTICULAR A CHASSIS OF A BRIDGE-UNDERSIDE INSPECTION APPARATUS

DESCRIPTION

Figure 1:
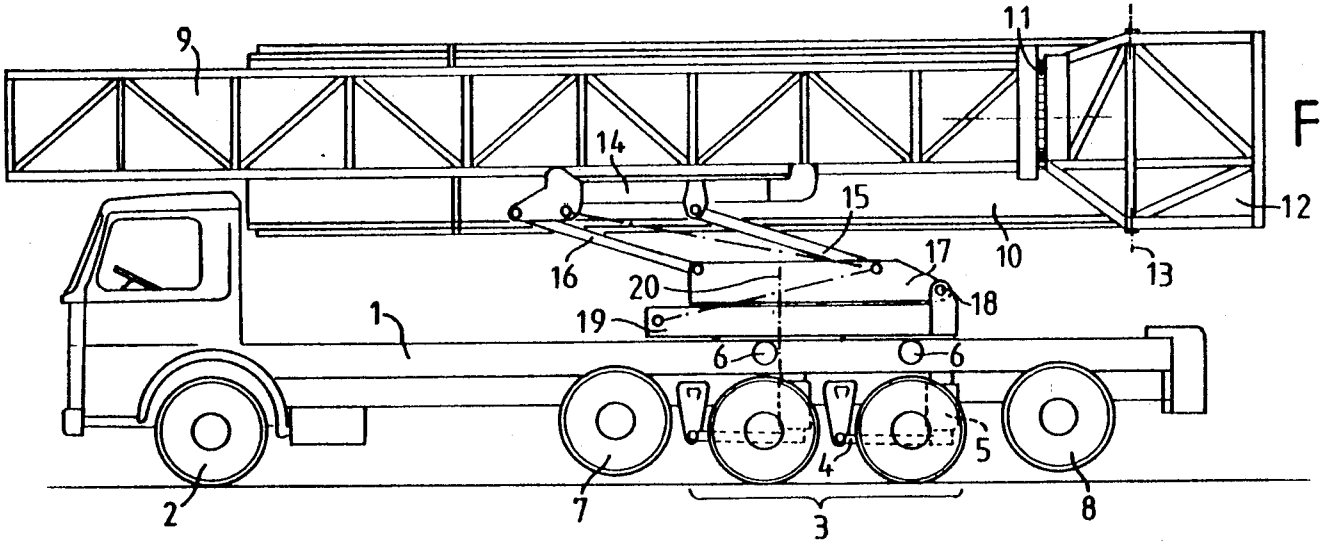

The invention relates to a vehicle, in particular a chassis of a bridge-underside inspection apparatus, having a frame and road-vehicle wheels. This arrangement starts from a vehicle which moves on public roads approximately at the speed of a truck.

In the case of so-called self-erecting bridge-underside inspection apparatuses or similar heavy special apparatuses having a wide projection, it is known to convert the chassis used for the road transport into an operational chassis before the same is put into working service, which operational chassis has greater stability than a conventional sprung and pneumatic-tired road vehicle. Further typical features of the equipment of an operational chassis are a remote-controlled slow drive and remote-controlled or automatic steering. In a bridge-underside inspection apparatus, the slow drive serves to move the apparatus during working service on a bridge. The steering requires only slight angles of lock in order to be able to accurately follow a predetermined track.

For example, it is known from German Offenlegungsschrift 3,305,384 to convert a road-transport chassis into an operational chassis by supports provided with running rollers being extended down from the frame onto the roadway, which supports take up most or all of the vehicle weight. In this known chassis the running rollers can be driven slowly and are steerable. So that the supports can be extended, it is known to attach them to the frame in a telescopic, hinged or displaceable manner, hydraulic lifting pistons being provided as a drive for the movement.

However, these supports and their operating mechanisms require considerable expediture, especially as the number of supports and running rollers should be as large as possible in the interest of reducing the maximum concentrated loading on the bridge surface.

On the other hand, vehicles, in particular trucks, having pneumatically actuated rear axles, in particular pneumatically sprung rear axles, are generally known. These axles are mounted on the frame by means of two longitudinal links in such a way as to be pivotable up and down and are supported on the frame via two sets of air bellows or cylinder arrangements. By reducing the pressure in the bellows or cylinders, the frame, with or without the load, can be lowered so far that it sits on unsprung stops of the axles. Conversely, by increasing the pressure, the frame can be lifted again and the spring-suspension behavior required for the road journey can be restored. It is known that this change in height is utilized in order to carry out a quick change of load, for example to pick up or set down a container standing on stilts.

The object of the invention is to propose a vehicle which performs both the function of a road-transport chassis and the function of an operational chassis, requires relatively low investment costs and can be changed over quickly and simply from one type of operation to the other.

This object is achieved according to the invention by a vehicle according to patent claim 1.

The essential difference between this vehicle and known convertible chassis for bridge-underside inspection apparatuses or similar appliances is that the unsprung auxiliary wheels, at least under load, are not vertically adjustable on the frame; on the contrary, the frame is lowered until these auxiliary wheels come in contact with the ground. Likewise in contrast to the prior art, the frame is not lowered by means of devices which are allocated to the auxiliary wheels but with the aid of the pneumatically sprung axle unit. Standard axle units which are on the market can be used, which standard axle units are relatively inexpensive, and special lifting devices on the auxiliary wheels are unnecessary.

The maximum lift of pneumatically actuated height-adjustment devices of standard truck axles is normally only about 12 cm. But that is sufficient, for the same rubber-tired wheels as in the pneumatically sprung axle units are also conveniently used as auxiliary wheels. Therefore if the auxiliary wheels briefly touch the ground now and again during the road journey as a result of unevenness or in the event of extremely pronounced spring deflection of the sprung wheels, this does no harm. The auxiliary wheels then simply run with the sprung wheels.

The pneumatically sprung axle unit can consist of one or more axles. The number of auxiliary wheels is determined by the stability required. A single auxiliary wheel may possibly be sufficient. Two auxiliary wheels are better, of which one is arranged in front of the axle unit and one behind the axle unit, and in fact preferably on the side facing the bridge edge during the working operation of the bridge-underside inspection apparatus. It is even more advantageous to provide at least one auxiliary axle having two auxiliary wheels. This auxiliary axle can also be attached in front of or behind the pneumatically sprung axle unit; or one auxiliary axle can be attached in front of the pneumatically sprung axle unit and one auxiliary axle behind it. The auxiliary wheels preferably run in the same track as the wheels of the sprung axle unit.

So that the operational chassis can be steered in working service, it is proposed that at least one auxiliary wheel or one auxiliary axle be designed to be steerable. A simple steering device is sufficient, since only small angles of lock are required. A steering device is convenient which normally assumes a middle position and, upon a "left" or "right" signal, makes predetermined fixed angles of lock. Furthermore, the auxiliary wheels are suitable for the arrangement of a slow drive.

If the auxiliary wheels or auxiliary axles are not fastened to the frame in a vertically adjustable manner, the ground clearance of the same during the road journey is determined by the lifting height of the pneumatically actuated lowering device However, if a greater ground clearance is desired by way of exception, an adjusting device can be attached to the relevant auxiliary axle, by means of which adjusting device this axle can be moved unloaded between two positions at different heights and can be locked on the frame in these positions. Simple manually actuated adjusting devices in particular can be considered here. Their attachment can also be worthwhile inasmuch as the selection of a pneumatically sprung axle unit having a relatively small stroke is more cost-effective.

The abovementioned fixed stops of the axles of the pneumatically sprung axle unit onto which the frame comes down during lowering are located relatively far to the inside, i.e. at a small distance from the longitudinal center plane of the vehicle. The supporting base of the frame on these axles during tilting in the transverse direction is therefore substantially smaller than the track width. An important further development of the invention then consists in an axially parallel supporting roller being arranged on the frame above at least one wheel of the axle unit, against which supporting roller the tire tread of the relevant wheel abuts in the bottom position of the frame. A plurality of supporting rollers can also be provided for one wheel. The main advantage of these supporting wheels consists in the fact that the tilting edge of the frame relative to the axles is shifted outward and the stability of the frame is thereby considerably increased. A further advantage of such supporting rollers consists in the fact that they can be equipped with a slow drive, for example a slow hydraulic drive. The supporting rollers then act as driving friction wheels on the rubber-tired wheels. The supporting rollers do not touch the tires during road-transport operation.

A further means of increasing the stability of the frame during working operation consists in the auxiliary wheels having tires with a harder spring-suspension behavior than the tires of the wheels of the axle unit. The tires can, for example, be expanded with plastic. If need be, the auxiliary wheels or some of them can be extendable in the axial direction so that the parking base can thereby be increased. The height of the auxiliary wheels and the stops on the frame is conveniently selected in such a way that the total axle load is uniformly distributed over the available axles when the frame is lowered into the bottom position.

The proposed vehicle can be designed as a self-propelled truck, as a trailer or as a semi-trailer. In the two first-mentioned cases, the steerable axle can also be used for steering during working operation. Apart from being used for a bridge-underside inspection apparatus, such a vehicle can also be used for mobile lifts, portable high-level working platforms or for machines doing mechanical work, e.g. road-making machines.

Figure 2:
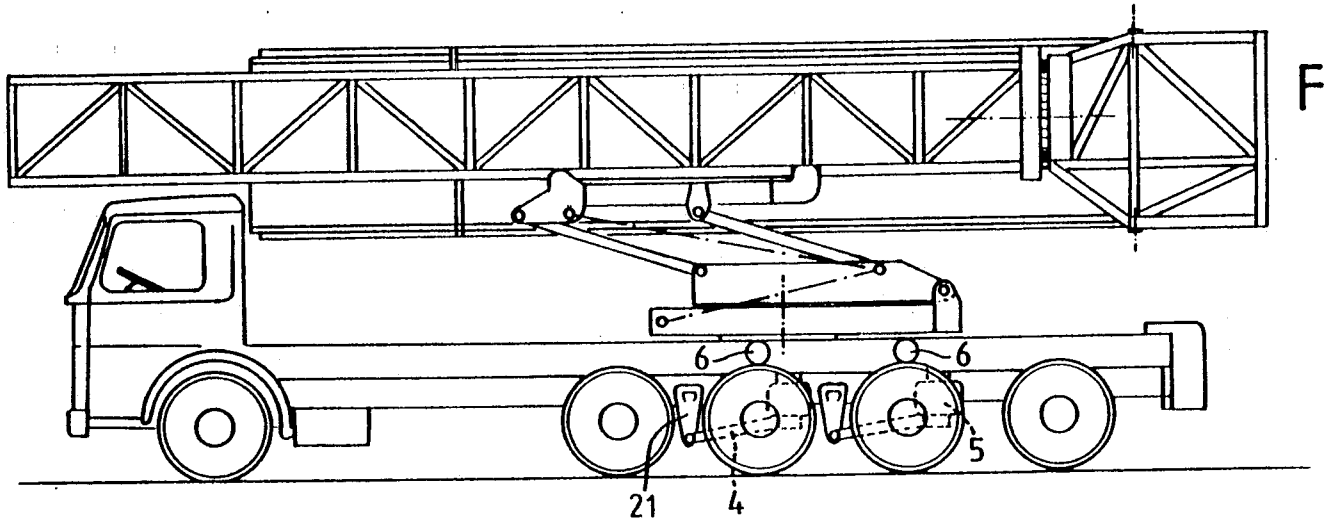
Figure 3:
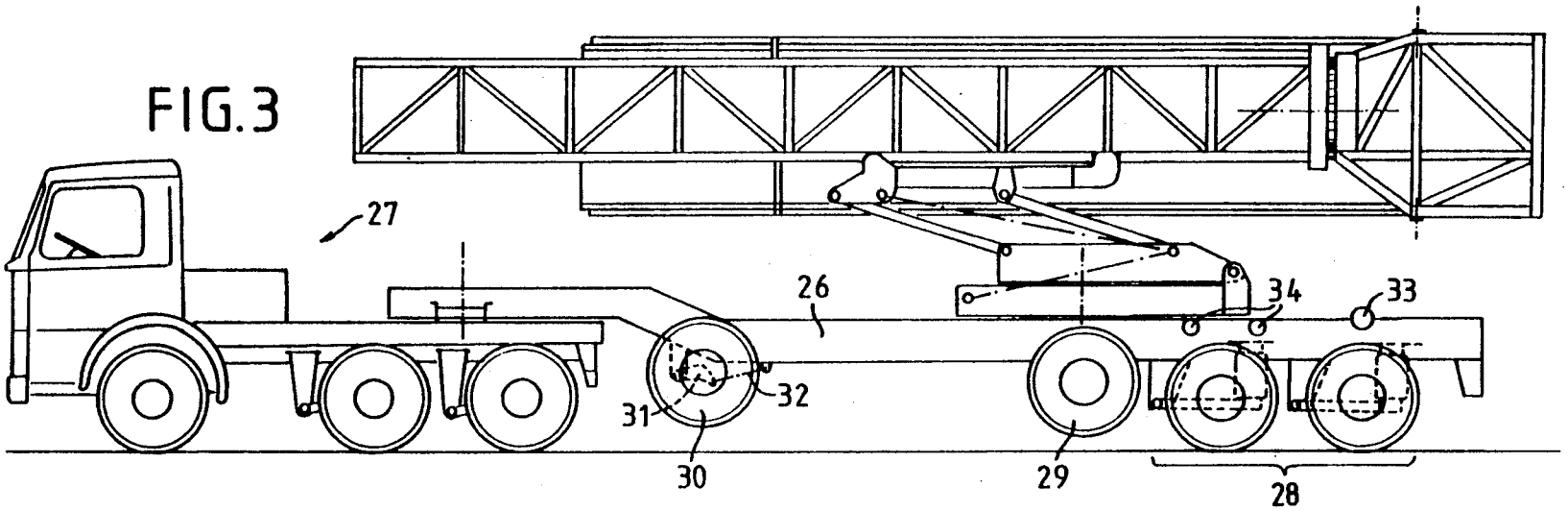
Figure 4:
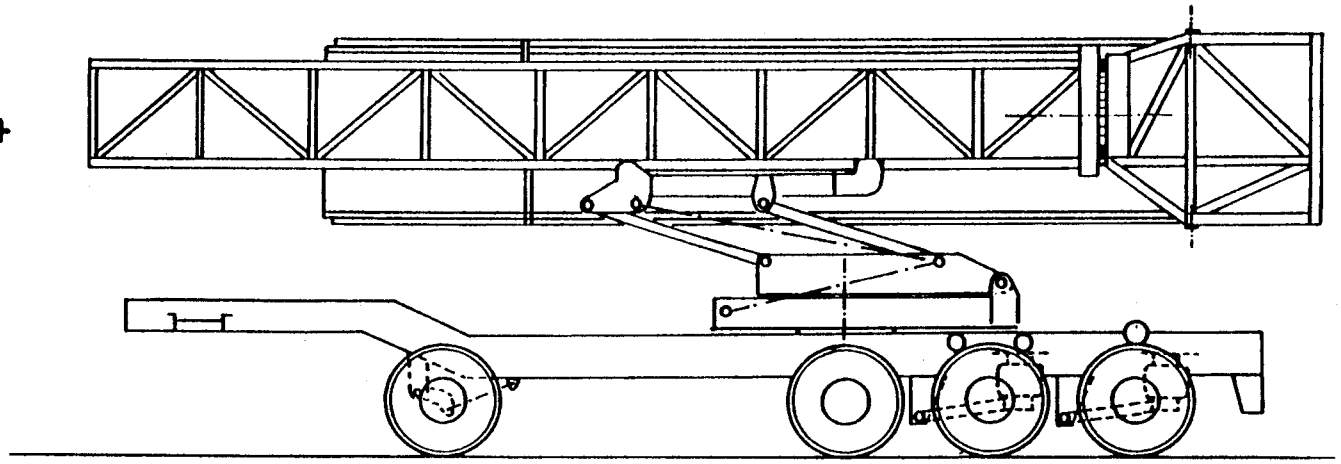

Two exemplary embodiments of the invention are described below with reference to the drawing, in which, in particular:

FIG. 1 shows the side view of a truck on which a bridge-underside inspection apparatus is erected, in the road-transport position, FIG. 2 shows the side view of this vehicle with lowered frame ready for working operation, FIG. 3 shows the side view of a bridge-underside inspection apparatus designed as a semi-trailer, in the road-transport position with tractor vehicle, FIG. 4 shows the side view of this apparatus ready for working operation.

Figure 6:
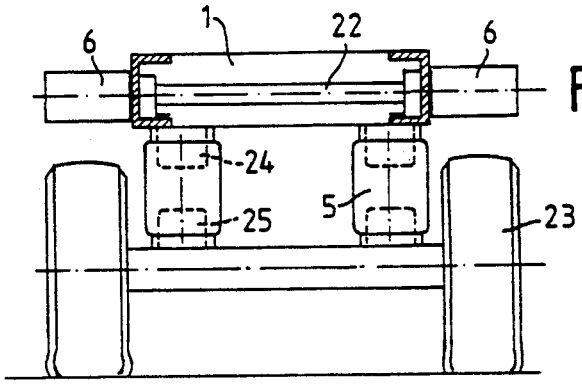
Figure 7:
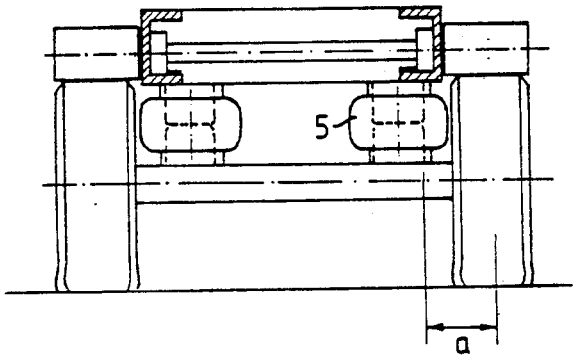
Figure 5:
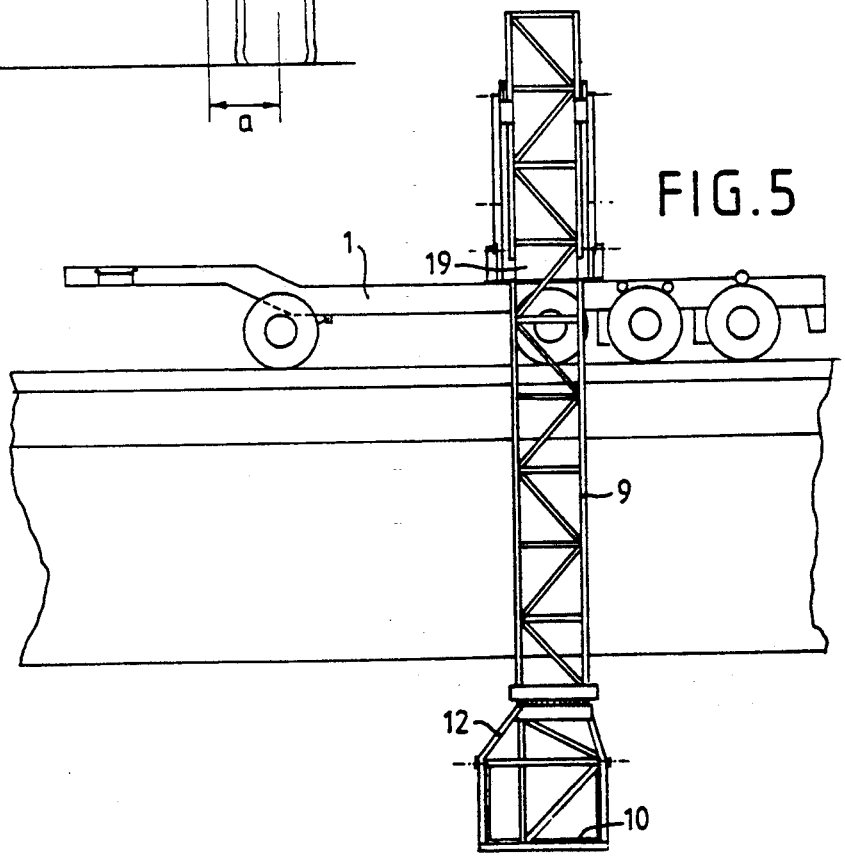

FIG. 5 to a smaller scale, shows the side view of the chassis according to FIG. 4 with set-up bridge-underside inspection apparatus during use on a bridge, FIG. 6 shows a schematic cross-section of such a vehicle in the area of the pneumatically sprung axle unit, the frame being located together with supporting rollers in the top position, and FIG. 7 shows the representation according to FIG. 6 with lowered frame.

The truck according to FIGS. 1 and 2 has a frame 1 designed as a flat platform and has a total of five axles which are provided with rubber-tired wheels of the same size, as are normally used for road-transport vehicles of this type. The front axle 2 is steerable and sprung in the conventional manner. The two center rear axles are the drive axles. They form an axle unit 3 having pneumatic spring suspension and a device for vertical adjustment. The two abovementioned axles are pivotably linked to the vehicle frame by means of longitudinal links 4. The air-filled spring bellows are indicated by 5. An axially parallel supporting roller 6 is arranged at a distance of about 12 cm above each of the four wheels of the axle unit 3. These supporting rollers can be slowly driven by means of rotating hydraulic motors. Located in front of and behind the axle unit 3 are auxiliary axles 7 and 8 respectively which are attached to the frame 1 in a fixed manner, i.e. not in a spring-mounted manner. The auxiliary wheels run in the track of the wheels of the axle unit 3. The wheels of the auxiliary axles 7 and 8 sit so high that they are at a distance of about 12 cm from the roadway surface.

The bridge-underside inspection apparatus attached to the frame 1 essentially consists of a lifting tower 9 and a working catwalk 10 which is tilted through 90° so that its floor is vertical. The lifting tower has a bottom tower section 12 which can be rotated about the tower axis by means of a slewing ring 11. The working catwalk 10 is linked to this tower section 12 in such a way as to be pivotable about a transverse axis 13. The lifting tower 9 is displaceably mounted in the longitudinal direction on a guide frame 14. This guide frame is linked to a hinged frame 17 by means of parallel levers 15 and 16. This hinged frame 17 is in turn mounted on a swivelling bolster 19 in such a way as to be movable about a horizontal transverse axis 18, which swivelling bolster 19 rotates on the frame 1 about a vertical axis 20.

With the folded bridge-underside inspection apparatus and the three sprung pneumatic-tired axles according to FIG. 1, the vehicle is suitable for road-transport operation. The supporting rollers 6 are clear and the wheels of the auxiliary axles 7 and 8 have no contact with the ground. Before the bridge-underside inspection apparatus is set up, the vehicle is prepared according to FIG. 2 by lowering the frame 1 for the working position. By reducing the air pressure in the spring bellows 5, the same are compressed under the weight of the loaded frame and become shorter. The frame sinks down until the auxiliary wheels come in contact with the ground and are loaded. The bearing blocks 21 of the longitudinal links have also been lowered with the frame 1, and the supporting rollers 6 press on the tires of the axle unit 3. The total axle load of the rear vehicle section therefore spreads from two to four axles.

FIGS. 6 and 7 show in particular the supporting rollers 6 more clearly. These supporting rollers 6 have a continuous shaft 22 and are designed in such a way that they can absorb the considerable radial forces of the wheels (here designated by 23) of the axle unit 3. During the lowering as a result of reducing the air pressure in the spring bellows 5, the top stops 24 fixed to the frame 1 come into contact with the bottom stops 25 fixed to the axle. This means that, in the lowered position—despite the supporting rollers 6—the outer lateral limit edges of the stops 24, which limit edges run in the longitudinal direction of the vehicle, are the determining tilting edges of the vehicle body. As a result of the loaded supporting rollers 6 according to FIG. 7, these tilting edges are shifted laterally outwards approximately by the distance a. The supporting rollers therefore make an important contribution to the stability of such an apparatus during working operation.

Apart from that, the friction contact between the supporting rollers and the wheels 23 is used for the slow movement of the vehicle on the bridge. The hydraulic motors (not shown) acting on the supporting rollers can also be remotely controlled from the working catwalk. The front axle 2, which can be equipped with a remote-control attachment, is used for the steering.

FIGS. 3 to 5 show as a second exemplary embodiment a semi-trailer on which an identical bridge-underside inspection apparatus is erected. In FIG. 3, the frame 26, likewise designed as a platform, is in the top position for road transport. The tractor vehicle 27 is coupled on. The semi-trailer has four axles. The two rear axles form a pneumatically sprung axle unit 28. A firmly attached auxiliary axle 29 is located directly in front of this axle unit 28, and, at a distance further forward, a further likewise unsprung auxiliary axle 30 is provided in the area of the offset portion of the semi-trailer neck. This auxiliary axle 30 is steerable and in addition is attached to short longitudinal levers 31 which, by means of a small hydraulic lifting cylinder 32 or a manually actuated winch, can be adjusted between a top and bottom position so that this auxiliary axle 30 can be lowered and lifted by about 10 cm. For the road-transport journey, it is located in its top position so that a ground clearance of 22 cm results. The auxiliary axle 29 has a ground clearance of 12 cm. The axle unit 28 is sprung. A supporting roller 33 above the last wheel and a supporting-roller pair 34 above the penultimate wheel are disengaged.

The tractor vehicle 27 is uncoupled in such a way that first of all the auxiliary axle 30 is moved into its bottom position and locked so that both auxiliary axles have the same ground clearance of 12 cm. The pneumatically actuated lowering devices on both the tractor vehicle and the axle unit 28 are now actuated. Thus all four axles of the semi-trailer take up the total axle load, as FIG. 4 shows. The tractor vehicle 27 can move away. The supporting rollers which have a slow hydraulic drive in this example too, are in engagement. With the simple steering device of the auxiliary axle 30, the vehicle can follow the predetermined track on the bridge.

In order to move the bridge-underside inspection apparatus into its working position according to FIG. 5, the swivelling bolster 19 (see FIG. 1) is rotated about its vertical axis 20, and at the same time the hinged frame 17 is swung up about its axis 18, and in fact by means of a lifting cylinder which is indicated by chain-dotted line. The bottom part 12 of the tower thus travels over the parapet of the bridge and swings increasingly further downward. In addition, the parallel arms 15, 16 can also be swung away from the hinged frame 17 likewise by means of a lifting cylinder indicated by chain-dotted line. When the swivelling bolster 19 has reached its 90° position and the lifting tower 9 is vertical, the working catwalk 10 is swung laterally about the axis 13 into the horizontal and then swung through 90° under the bridge by means of the slewing ring 11. FIG. 5 shows this working position.

A multiplicity of variants of the axle arrangements described in these examples is possible. The semi-trailer could, for example, have a sprung axle unit with three axles. An auxiliary axle could also be arranged behind the axle unit, in which case the front auxiliary axle 30, which can be lifted free of load, could be omitted depending on the longitudinal position of the center of gravity of the vehicle. In this case, one or more auxiliary axles ought to be steerable. More or less axles could also be provided on the truck. The steerability of the rear auxiliary axle behind the sprung axle unit would also be advantageous.

1—Frame
2—Front axle
3—Axle unit
4—Longitudinal link
5—Spring bellows
6—Supporting roller
7—Auxiliary axle
8—Auxiliary axle
9—Lifting tower
10—Working catwalk
11—Slewing ring
12—Tower section
13—Transverse axis
14—Guide frame
15—Parallel lever
16—Parallel lever
17—Hinged frame
18—Transverse axis
19—Swivelling bolster
20—Vertical axis
21—Bearing block
22—Shaft
23—Wheel
24—Stop
25—Stop
26—Frame
27—Tractor vehicle
28—Axle unit
29—Auxiliary axle
30—Auxiliary axle
31—Longitudinal lever
32—Lifting cylinder
33—Supporting roller
34—Supporting-roller pair
a—Distance

I claim:

1. A vehicle, in particular a chassis of a bridge-underside inspection apparatus, having a frame and road-vehicle wheels, wherein a pneumatically sprung axle unit (3) is provided with at least one axle which has a pneumatically actuated device (4, 5) which is connected to the spring-suspension arrangement and by means of which the frame (1) can be lowered from a top position in which the spring suspension is effective into a bottom position in which the frame rests unsprung on supporting stops (24, 25) of the axles of this axle unit, and wherein at least one unsprung auxiliary wheel is arranged on the frame (1) in front of and/or behind the axle unit (3), which auxiliary wheel is lifted from the roadway in the top position of the frame, is lowered together with the frame (1) and, in the bottom position of the frame, stands on the roadway and takes up a portion of the total axle load.

2. The vehicle as claimed in claim 1, wherein at least one auxiliary axle (7, 8) is provided with two auxiliary wheels.

3. The vehicle as claimed in claim 1, wherein at least one auxiliary wheel is steerable.

4. The vehicle as claimed in claim 2, wherein one auxiliary axle (30) has an adjusting device (31, 32) by means of which it can be moved unloaded between two positions at different heights and can be locked on the frame (26) in these positions.

5. The vehicle as claimed in claim 1, which comprises a design as a semi-trailer (FIG. 3).

6. The vehicle as claimed in claim 1, wherein at least one of the wheels has a slow drive.

7. The vehicle as claimed in claim 1, wherein an axially parallel supporting roller (6) is arranged on the frame (1) above at least one wheel of the axle unit (3), against which supporting roller (6) the tire tread of the wheel abuts in the bottom position of the frame.

8. The vehicle as claimed in claim 7, wherein a plurality of supporting rollers (34) are provided for one wheel.

9. The vehicle as claimed in claim 7, wherein the supporting roller can be driven slowly.

10. The vehicle as claimed in claim 1, wherein the auxiliary wheels have tires with a harder spring-suspension behavior than the tires of the wheels of the axle unit.

* * * * *